US011993911B2

(12) United States Patent
Tamba et al.

(10) Patent No.: US 11,993,911 B2
(45) Date of Patent: May 28, 2024

(54) WORKING MACHINE

(71) Applicant: KUBOTA CORPORATION, Osaka (JP)

(72) Inventors: Daiki Tamba, Sakai (JP); Yukifumi Yamanaka, Sakai (JP)

(73) Assignee: KUBOTA CORPORATION, Osaka (JP)

( * ) Notice: Subject to any disclaimer, the term of this patent is extended or adjusted under 35 U.S.C. 154(b) by 319 days.

(21) Appl. No.: 17/542,577

(22) Filed: Dec. 6, 2021

(65) Prior Publication Data

US 2022/0090344 A1 Mar. 24, 2022

Related U.S. Application Data

(63) Continuation of application No. PCT/JP2020/024416, filed on Jun. 22, 2020.

(30) Foreign Application Priority Data

Jun. 28, 2019 (JP) ..... 2019-122520

(51) Int. Cl.
*E02F 9/20* (2006.01)
*E02F 3/34* (2006.01)

(52) U.S. Cl.
CPC ..... *E02F 3/3414* (2013.01); *E02F 9/2075* (2013.01)

(58) Field of Classification Search
CPC ..... E02F 3/3414; E02F 9/2075; E02F 9/20; F02D 9/00; F02D 29/02; F02D 29/00;
(Continued)

(56) References Cited

U.S. PATENT DOCUMENTS 9,561,789 B2 * 2/2017 Nishi ..... B60K 6/485
9,776,615 B2 * 10/2017 Matsuzaki ..... B60W 10/30
(Continued)

FOREIGN PATENT DOCUMENTS

JP 10-23604 A 1/1998
JP 2013-203234 A 10/2013
(Continued)

OTHER PUBLICATIONS

Official Communication issued in International Patent Application No. PCT/JP2020/024416, mailed on Sep. 1, 2020.

*Primary Examiner* — James A Shriver, II
*Assistant Examiner* — Hilary L Johns
(74) *Attorney, Agent, or Firm* — Keating & Bennett, LLP

(57) ABSTRACT

A working machine includes a machine body, an engine on the machine body, a motor/generator to perform an assisting action in which the motor/generator functions as a motor to assist the engine in driving and an electricity generating action in which the motor/generator functions as a generator to generate electricity using power from the engine, a battery to store electricity generated by the motor/generator, an operation actuator to perform an operation of the machine body, a starting action determiner to determine, upon operation of the operation actuator, whether the operation corresponds to a starting action for the machine body, a first setter to set, if the starting action determiner determines that the operation of the operation actuator corresponds to the starting action, a torque of the motor/generator for the assisting action or the electricity generating action to a first torque, and a second setter to set, if the starting action determiner determines that the operation of the operation actuator does not correspond to the starting action, the torque for the assisting action or the electricity generating action to a
(Continued)

second torque differing from the first torque set by the first setter.

5 Claims, 10 Drawing Sheets

(58) Field of Classification Search
CPC ..... B60W 20/10; B60W 10/06; B60W 10/08; B60W 20/19; B60W 2710/08; B60W 10/02; B60W 10/10; B60W 10/30; B60W 2300/152; B60W 2510/06; B60W 2510/0657; B60W 2710/0644; B60W 2710/083; B60W 20/40; B60W 2300/17; B60W 2510/0638; Y02T 10/62; Y02T 10/64; Y02T 10/70; Y02T 10/7072; Y02T 10/72; B60L 2200/40; B60L 2240/421; B60L 2240/423; B60L 2240/441; B60L 2240/443; B60L 2240/549; B60L 2250/12
USPC ..... 180/65.21
See application file for complete search history.

(56) References Cited

U.S. PATENT DOCUMENTS

| | | | | |
|---|---|---|---|---|
| 2014/0148984 | A1* | 5/2014 | Nishi | B60W 20/10 180/65.265 |
| 2016/0046278 | A1* | 2/2016 | Matsuzaki | B60W 10/08 903/930 |
| 2017/0362799 | A1* | 12/2017 | Nakagawa | B60K 6/48 |

FOREIGN PATENT DOCUMENTS

| | | | |
|---|---|---|---|
| JP | 2014-065347 | A | 4/2014 |
| JP | 2017-226284 | A | 12/2017 |

* cited by examiner

WORKING MACHINE

CROSS REFERENCE TO RELATED APPLICATIONS

This application is a continuation application of International Application No. PCT/JP2020/024416, filed on Jun. 22, 2020, which claims the benefit of priority to Japanese Patent Application No. 2019-122520, filed on Jun. 28, 2019. The entire contents of each of these applications are hereby incorporated herein by reference.

BACKGROUND OF THE INVENTION

1. Field of the Invention

The present invention relates to a working machine such as a compact track loader or a skid-steer loader.

2. Description of the Related Art

With regard to a working machine such as a compact track loader, Japanese Unexamined Patent Application Publication No. 2017-226284 is known as a hybrid-type working machine which includes an engine and a motor/generator. The working machine of Japanese Unexamined Patent Application Publication No. 2017-226284 includes an engine, a motor/generator configured to perform a first action in which the motor/generator functions as a motor using electricity and a second action in which the motor/generator functions as a generator using power from the engine, a driving device configured to function using the power from the engine and/or power from the motor/generator, a battery configured to store electricity generated by the second action by the motor/generator, a charged amount measuring device configured to detect the charged amount of the battery, and a controller which is configured to control the functioning of the motor/generator and which is configured to make settings on the first action or the second action based on the charged amount.

SUMMARY OF THE INVENTION

In Japanese Unexamined Patent Application Publication No. 2017-226284, an assisting action (first action) or an electricity generating action (second action) is selected based on the rotation speed of the engine, and it is possible to perform the assisting action efficiently according to the state of the engine. However, when the assisting action or the electricity generating action is performed, the behavior of the working machine at the time of a starting action is not taken into consideration.

Preferred embodiments of the present invention provide working machines which each makes it possible to efficiently perform an assisting action or an electricity generating action when a starting action for the working machine is performed.

A working machine according to a preferred embodiment of the present invention includes a machine body, an engine on the machine body, a motor/generator to perform an assisting action in which the motor/generator functions as a motor to assist the engine in driving and an electricity generating action in which the motor/generator functions as a generator to generate electricity using power from the engine, a battery to store electricity generated by the motor/generator, an operation actuator to perform an operation of the machine body, a starting action determiner to determine, upon operation of the operation actuator, whether the operation corresponds to a starting action for the machine body, a first setter to set, if the starting action determiner determines that the operation of the operation actuator corresponds to the starting action, a torque of the motor/generator for the assisting action or the electricity generating action to a first torque, and a second setter to set, if the starting action determiner determines that the operation of the operation actuator does not correspond to the starting action, the torque for the assisting action or the electricity generating action to a second torque differing from the first torque set by the first setter.

The starting action determiner determines that the operation of the operation actuator corresponds to the starting action if an amount of change of the operation actuator is equal to or greater than a predetermined amount, and determines that the operation of the operation actuator does not correspond to the starting action if the amount of change of the operation actuator is less than the predetermined amount.

The machine body includes a traveling device to function using power from the engine and the motor/generator, and the operation actuator is a travel operation actuator to operate the traveling device.

The first setter sets the torque based on first control information indicating a relationship between a rotation speed of the engine and the first torque, and the second setter sets the torque based on the second control information indicating a relationship between the rotation speed of the engine and the second torque, the other relationship differing from the relationship used by the first setter.

The starting action determiner determines whether or not the operation of the operation actuator corresponds to the starting action based on a decrease in the rotation speed of the engine in a case where the operation actuator is operated.

The above and other elements, features, steps, characteristics and advantages of the present invention will become more apparent from the following detailed description of the preferred embodiments with reference to the attached drawings.

BRIEF DESCRIPTION OF THE DRAWINGS

A more complete appreciation of preferred embodiments of the present invention and many of the attendant advantages thereof will be readily obtained as the same becomes better understood by reference to the following detailed description when considered in connection with the accompanying drawings described below.

DETAILED DESCRIPTION OF THE PREFERRED EMBODIMENTS

Figure 1:
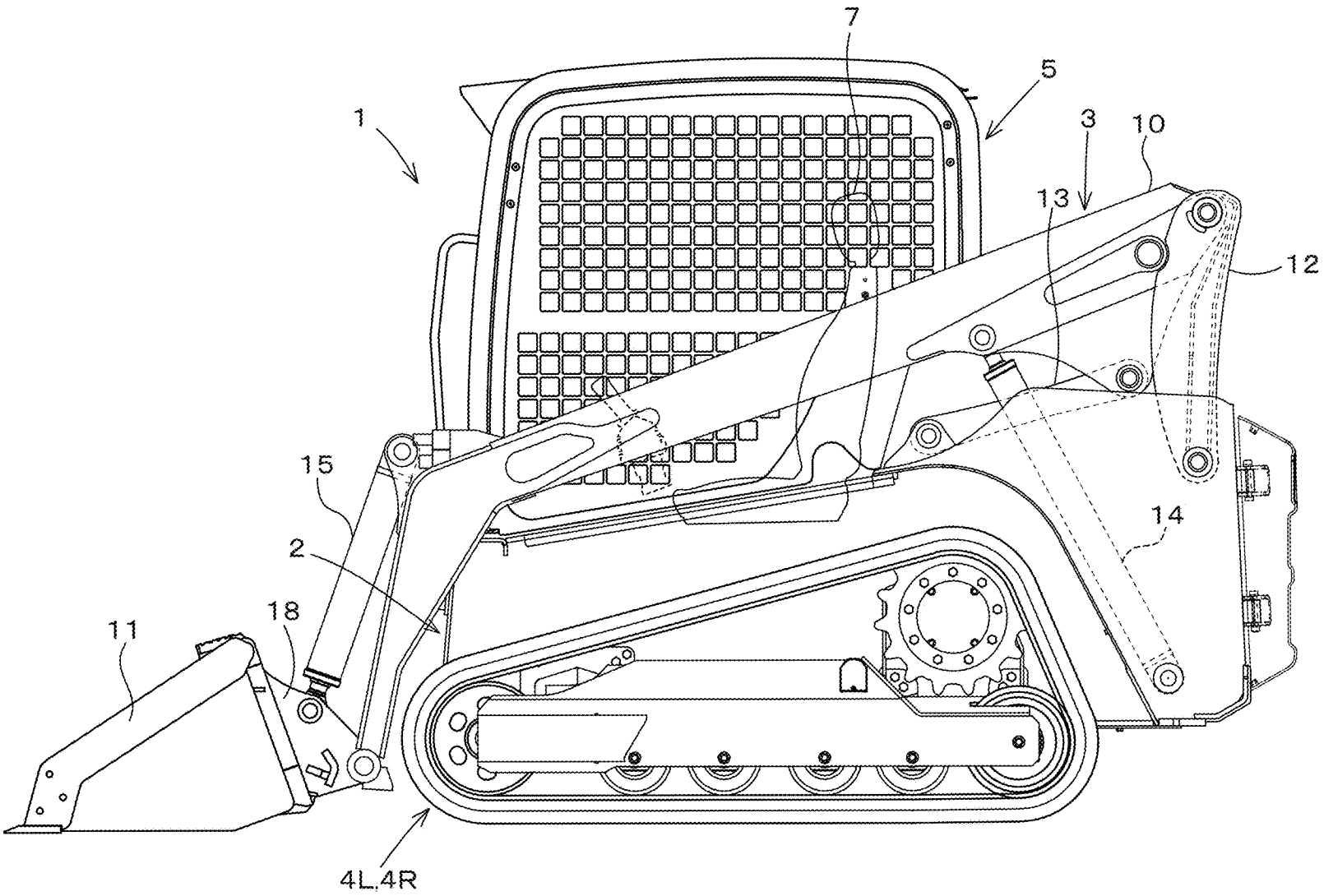
FIG. 1 is a general side view of a working machine.

The preferred embodiments of the present invention will now be described with reference to the accompanying drawings, wherein like reference numerals designate corresponding or identical elements throughout the various drawings. The drawings are to be viewed in an orientation in which the reference numerals are viewed correctly.

The following description discusses preferred embodiments of working machines according to the present invention with reference to drawings.

FIG. 1 is a side view of a working machine 1 according to a preferred embodiment of the present invention. FIG. 1 illustrates a compact track loader as an example of a working machine. Note, however, that the working machines according to preferred embodiments of the present invention are not limited to a compact track loader and may be, for example, another type of loader working machine such as a skid-steer loader. The working machines according to preferred embodiments of the present invention may be working machines other than loader working machines. Note that the description in the present application is based on the assumption that the front end (left in FIG. 1) of the working machine as viewed from an operator seated on an operator's seat of the working machine is "front" or forward", that the rear end (right in FIG. 1) as viewed from the operator is "rear" or "rearward", that the left side (near side in FIG. 1) as viewed from the operator is "left" or "leftward", and that the right side (far side in FIG. 1) as viewed from the operator is "right" or "rightward". The description may be based on the assumption that a direction orthogonal to a front-rear direction of the machine body is "machine body width direction (width direction)."

The working machine 1 includes a machine body 2, a working device 3, and a pair of traveling devices 4L and 4R.

A cabin 5 is mounted above a front portion of the machine body 2. A rear portion of the cabin 5 is supported on a bracket of the machine body 2 swingably about a support shaft. A front portion of the cabin 5 is configured to be placed on the front portion of the machine body 2. The cabin 5 is provided with an operator's seat 7 therein.

The pair of traveling devices 4L and 4R preferably include crawler-type traveling devices. The traveling device 4L is provided on one of the opposite sides (left side) of the machine body 2, and the traveling device 4R is provided on the other of the opposite sides (right side) of the machine body 2.

The working device 3 includes booms 10, boom cylinders 14, working tool cylinders 15, and a working tool 11. Each boom 10 is supported by a lift link 12 and a control link 13. The boom cylinders 14, which each preferably include a double-acting hydraulic cylinder, are provided between proximal portions of the booms 10 and a lower rear portion of the machine body 2. Concurrent extension or retraction of the boom cylinders 14 causes the booms 10 to swing up or down. Each boom 10 has, at a distal end thereof, a mounting bracket 18 supported pivotably about a lateral axis, and a back of the working tool 11 is attached to such mounting brackets 18 provided on left and right sides. That is, the working tool 11 is attached to distal ends of the booms 10.

Furthermore, each of the working tool cylinders 15, including a double-acting hydraulic cylinder, is provided between a corresponding mounting bracket 18 and an intermediate portion of a distal portion of a corresponding boom 10. Extension or retraction of the working tool cylinders 15 causes the working tool 11 to swing (scoop action, dump action).

The working tool 11 is configured to be attached to and detached from the mounting brackets 18. The working tool 11 is, for example, an attachment (auxiliary attachment) such as a bucket, a hydraulic crusher, a hydraulic breaker, an angle broom, an earth auger, a pallet fork, a sweeper, a mower, or a snow blower.

The following description discusses the machine body.

Figure 2:
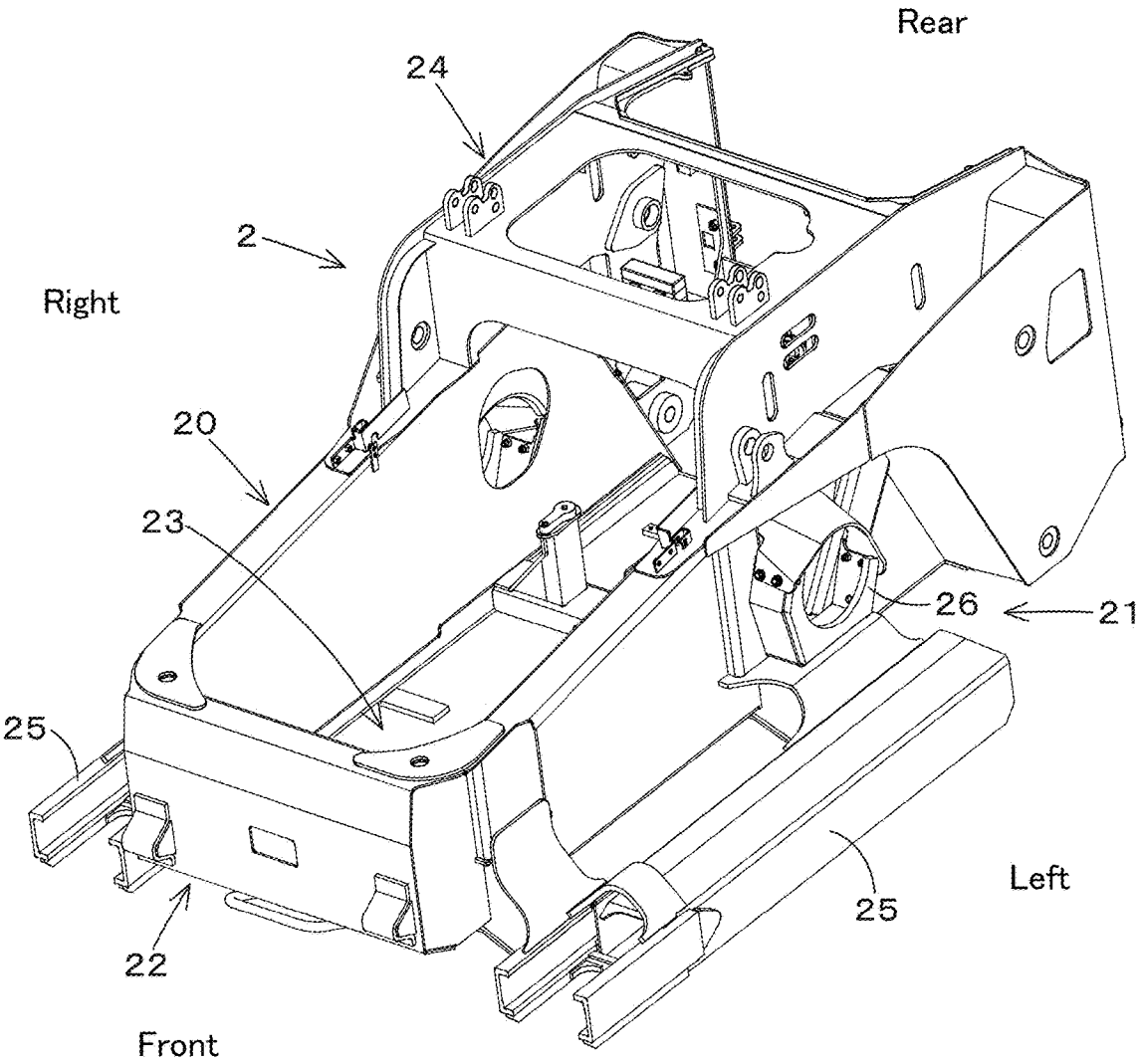
FIG. 2 is a perspective view of a machine body.

As illustrated in FIG. 2, the machine body 2 includes a right frame portion 20, a left frame portion 21, a front frame portion 22, a bottom frame portion 23, and a top frame portion 24.

The right frame portion 20 defines a right portion of the machine body 2. The left frame portion 21 defines a left portion of the machine body 2. The front frame portion 22 defines a front portion of the machine body 2 and connects front portions of the right frame portion 20 and the left frame portion 21 together. The bottom frame portion 23 defines a bottom portion of the machine body 2 and connects lower portions of the right frame portion 20 and the left frame portion 21 together. The top frame portion 24 defines an upper rear portion of the machine body 2 and connects upper rear portions of the right frame portion 20 and the left frame portion 21 together.

Rear portions of the right frame portion 20 and the left frame portion 21 swingably support the booms 10 or the like. The right frame portion 20 and the left frame portion 21 are each provided with a track frame 25 and a motor mounting portion 26.

Figure 3:
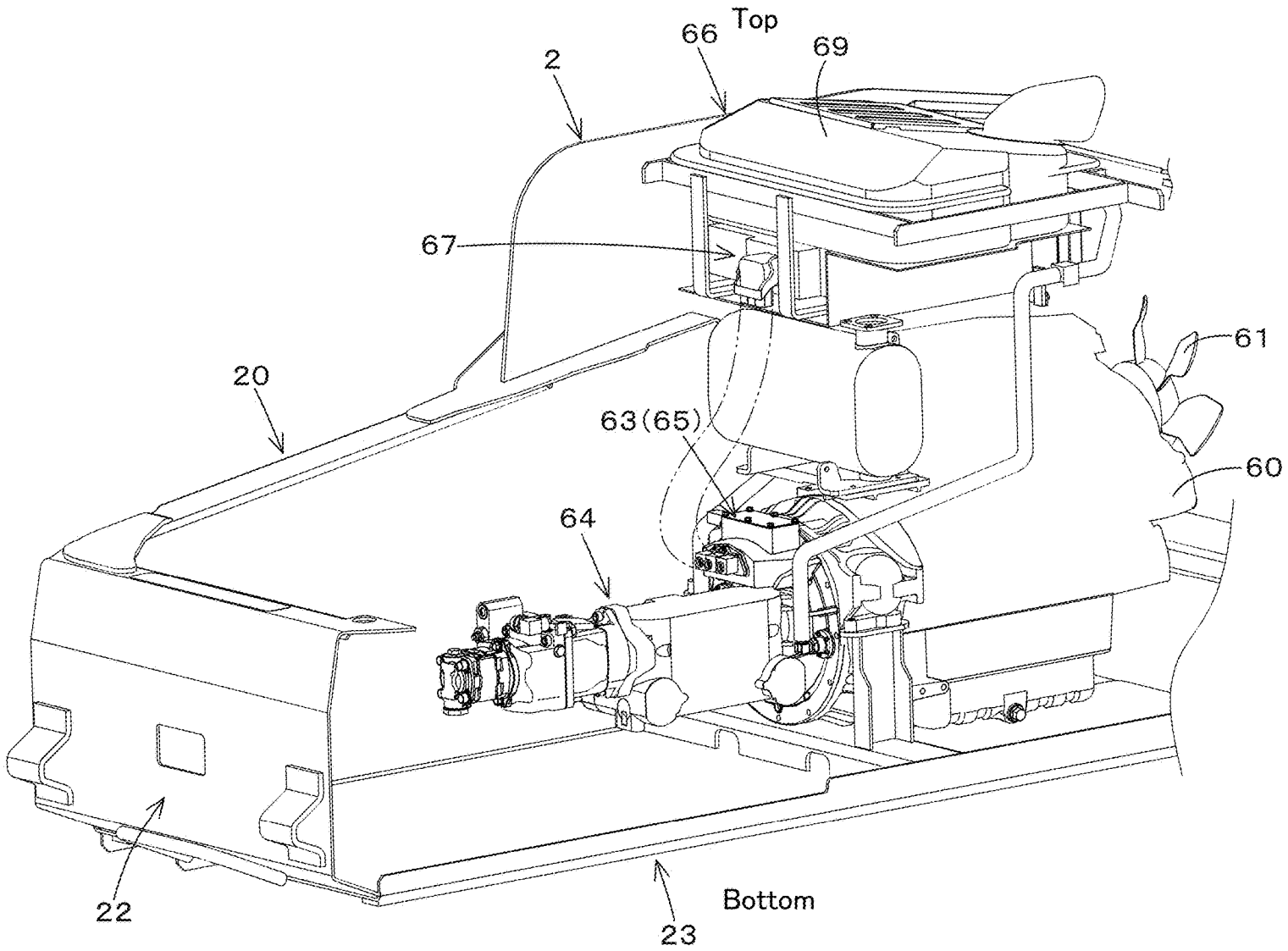
FIG. 3 is a perspective view illustrating how pieces of equipment (devices) are arranged.

As illustrated in FIG. 3, the machine body 2 is provided with an engine 60, a cooling fan 61, a radiator, a motor/generator 63, and a hydraulic driver 64. The engine 60 is an internal combustion engine such as a diesel engine or a gasoline engine. The cooling fan 61 is driven by power from the engine 60. The radiator cools cooling water for the engine 60. The motor/generator 63 performs an assisting action in which the motor/generator 63 functions as a motor to assist the engine 60 in driving and an electricity generating action in which the motor/generator 63 functions as a generator to generate electricity using the power from the engine 60. The motor/generator 63 is a motor/generator and uses a permanent magnet three-phase AC synchronous motor as a driver.

Figure 5:
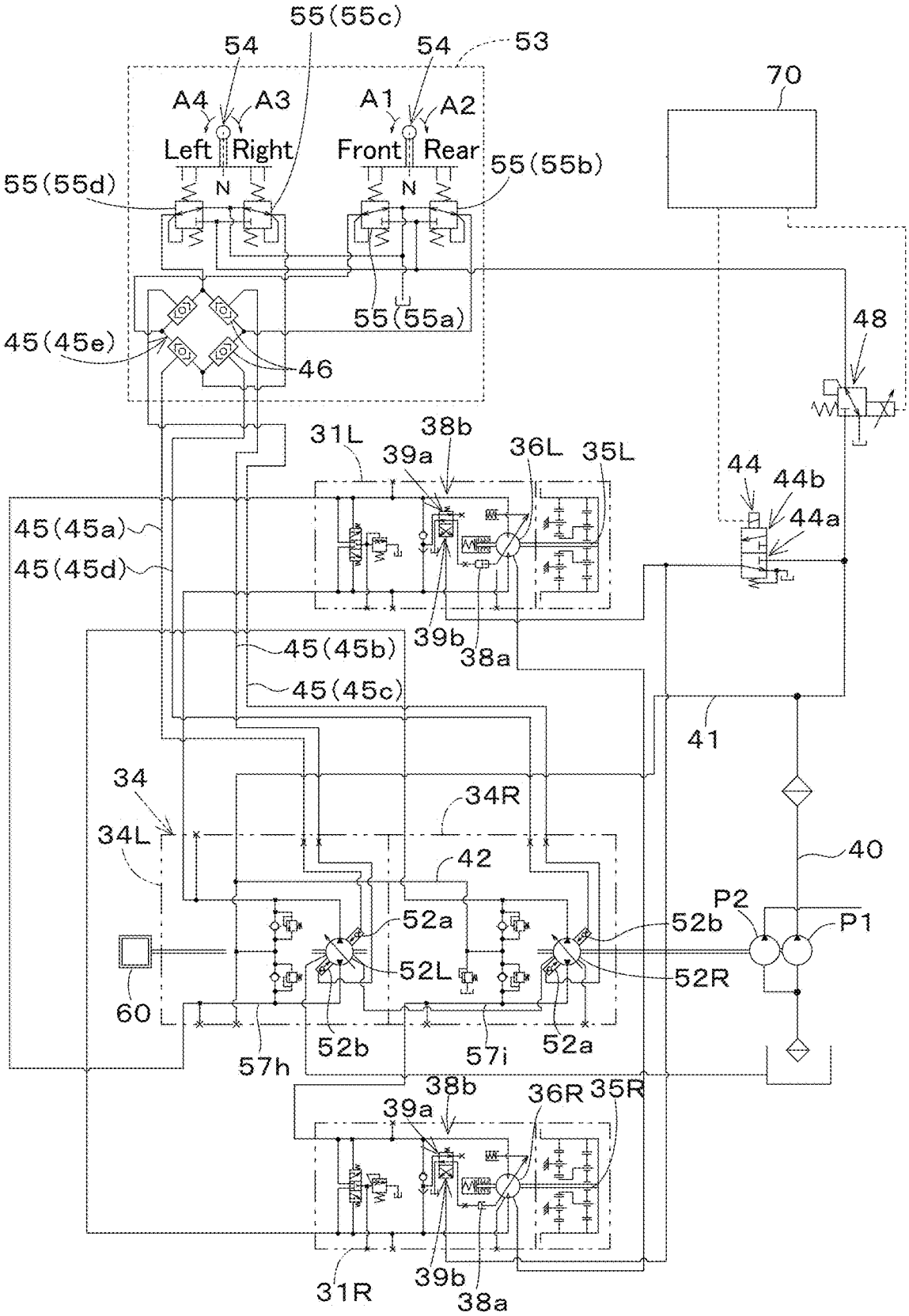
FIG. 5 shows a hydraulic system of a travel system.
Figure 6:
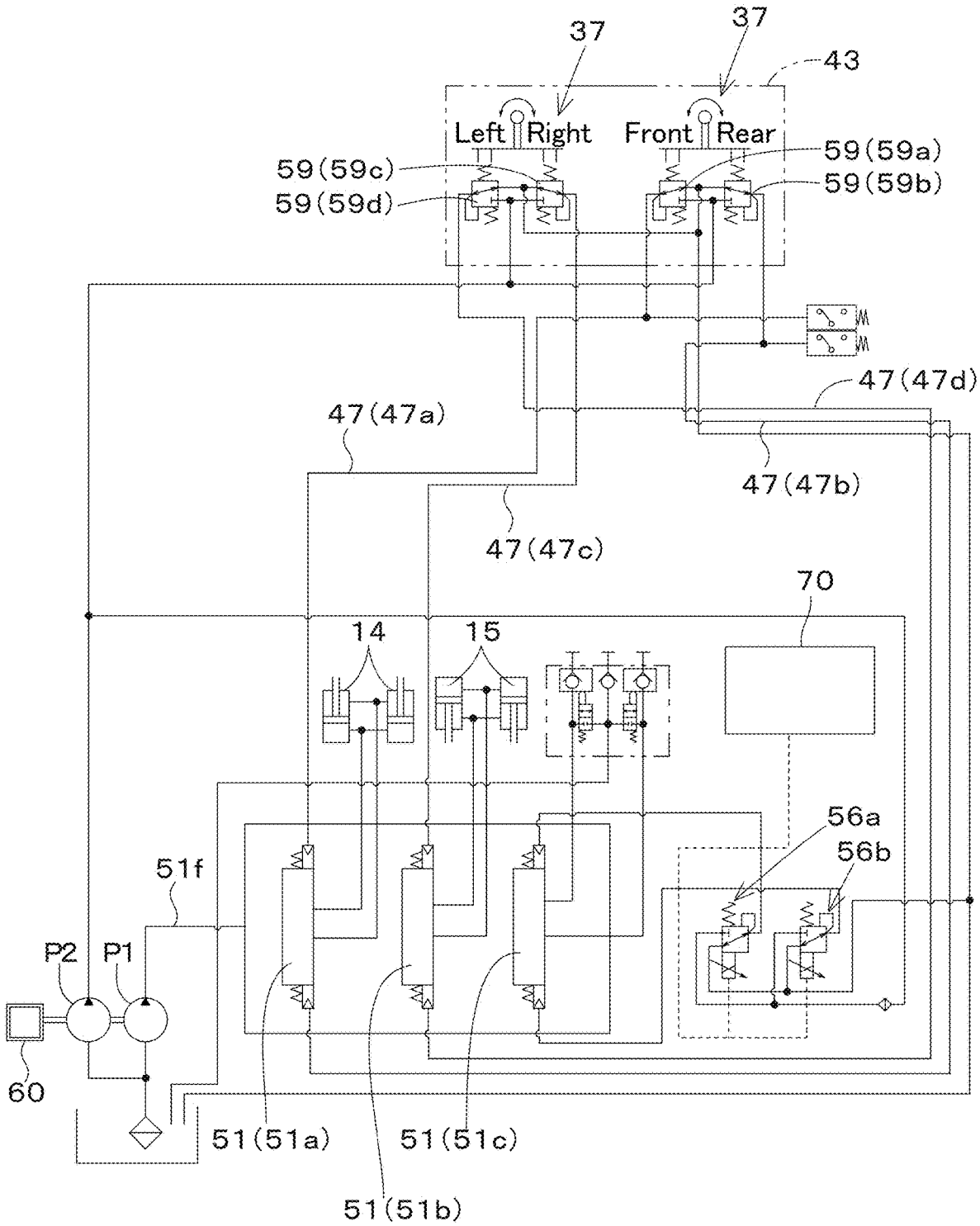
FIG. 6 shows a hydraulic system of a work system.

The hydraulic driver 64 is a device driven by power from the engine 60 and/or the motor/generator 63, and outputs power mainly for work. The hydraulic driver 64 is provided forward of the motor/generator 63. The hydraulic driver 64 includes a plurality of hydraulic pumps. The plurality of hydraulic pumps include, for example, as illustrated in FIGS. 5 and 6, a travel pump 52L, a travel pump 52R, a sub-pump P1, and a main pump P2.

The machine body 2 is provided with a battery 66 and an electricity controller 67. The battery 66 stores electricity generated by the motor/generator 63 and supplies the stored electricity to the motor/generator 63 and the like. As illustrated in FIG. 2, the electricity controller 67 includes an inverter 67A and an inverter control unit 67B. The amount of electricity stored in the battery 66 (remaining battery power) can be detected by a battery level sensor 97 of the battery 66.

With the working machine 1, the hydraulic driver 64 can be driven by power from the engine 60, the hydraulic driver 64 can be driven using both the engine 60 and the motor/generator 63, and the motor/generator 63 can be caused to function to generate electricity using power from the engine 60. That is, transmission of power in the working machine is of a parallel hybrid type. The following description discusses a structure which transmits power from the engine 60 and the motor/generator 63.

Figure 4:
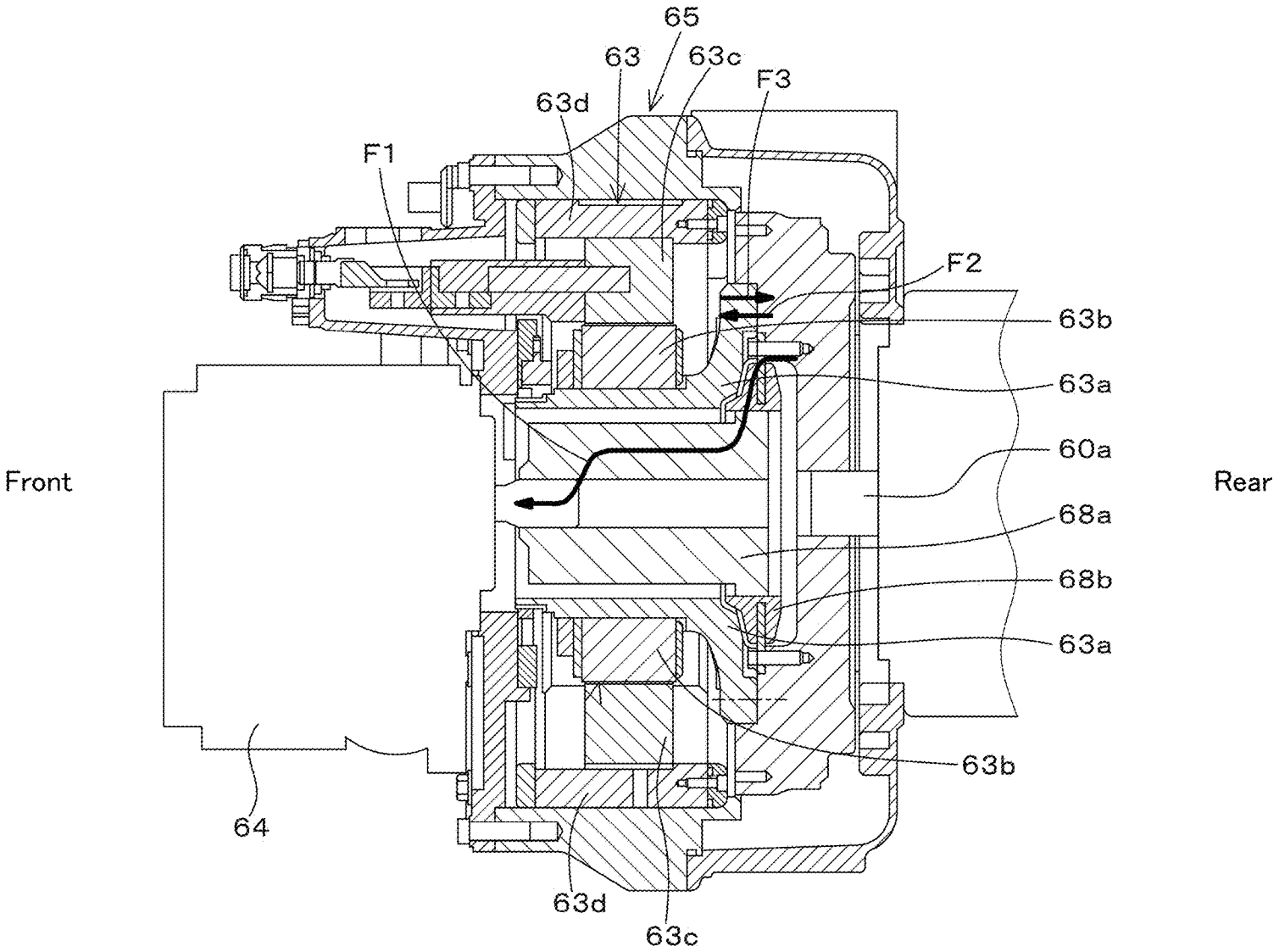
FIG. 4 is a cross-sectional view of an interior of a rotating electrical machine.

As illustrated in FIGS. 3 and 4, a housing 65 which houses a substantially disc-shaped flywheel and the motor/generator 63 is provided in front of the engine 60. The motor/generator 63 includes a connector 63*a* connected to the flywheel, a rotor 63*b* fixed to the connector 63*a*, a stator 63*c* provided on the rotor 63*b*, and a water jacket 63*d* provided outside the stator 63*c*.

The connector 63*a* is in the form of a tube and includes a rear end attached to the flywheel. The connector 63*a* has an intermediate shaft 68*a* provided in the space defined thereby. The intermediate shaft 68*a* has a coupling 68*b* provided at a rear end thereof, and an outer edge of the coupling 68*b* is connected to the flywheel. Furthermore, the intermediate shaft 68*a* has a drive shaft of the hydraulic driver 64 connected to a front end thereof.

Accordingly, when the engine 60 is driven, rotating power from a crankshaft (output shaft) 60*a* of the engine 60 is transmitted to the flywheel and causes the flywheel to rotate. As indicated by arrow F1 in FIG. 4, the rotating power from the flywheel is transmitted from the coupling 68*b* to the intermediate shaft 68*a* and then transmitted from the intermediate shaft 68*a* to the drive shaft of the hydraulic driver 64, making it possible to drive the hydraulic driver 64.

Furthermore, as indicated by arrow F2 in FIG. 4, the rotating power from the flywheel is transmitted via the connector 63*a* to the rotor 63*b*. Therefore, transmission of the rotating power from the engine 60 to the rotor 63*b* (connector 63*a*) allows the motor/generator 63 to function as a generator. On the other hand, supplying electricity stored in the battery 66 to the stator 63*c* allows the rotor 63*b* to rotate. As indicated by arrow F3, the rotating power from the rotor 63*b* can be transmitted to the flywheel via the connector 63*a*. This makes it possible to cause the motor/generator 63 to function as an electric motor to assist the engine 60.

FIGS. 5 and 6 each show a hydraulic circuit (hydraulic system) of the working machine. FIG. 5 is a hydraulic system of a travel system, and FIG. 6 is a hydraulic system of a work system.

As shown in FIG. 5, the hydraulic system of the travel system causes the traveling devices 4L and 4R to function using hydraulic pressure that occurs when the hydraulic driver 64 is driven. The hydraulic system of the travel system includes the sub-pump P1 which is a hydraulic pump to discharge hydraulic fluid, a first travel motor mechanism 31L, a second travel motor mechanism 31R, and a travel drive mechanism 34.

The sub-pump P1 includes a fixed displacement gear pump. The sub-pump P1 is configured to discharge hydraulic fluid from a tank (hydraulic fluid tank). There is a discharge fluid passage 40, which allows passage of hydraulic fluid, on the discharge side of the sub-pump P1. The discharge fluid passage 40 has a first charge fluid passage 41 connected to the discharge side thereof. The first charge fluid passage 41 extends to reach the travel drive mechanism 34. A portion of the hydraulic fluid discharged from the sub-pump P1 that is used for control may be referred to as a pilot fluid, and the pressure of the pilot fluid may be referred to as a pilot pressure.

The travel drive mechanism 34 drives the first travel motor mechanism 31L and the second travel motor mechanism 31R, and includes a driver circuit (left driver circuit) 34L to drive the first travel motor mechanism 31L and a driver circuit (right driver circuit) 34R to drive the second travel motor mechanism 31R.

The driver circuits 34L and 34R include respective travel pumps 52L and 52R, respective speed change fluid passages 57*h* and 57*i*, and a second charge fluid passage 42. The speed change fluid passages 57*h* and 57*i* are fluid passages connecting the travel pumps 52L and 52R with travel motors 36L and 36R. The second charge fluid passage 42 is a fluid passage connected to the speed change fluid passages 57*h* and 57*i* and supplies hydraulic fluid from the sub-pump P1 to the speed change fluid passages 57*h* and 57*i*. Each of the travel pumps 52L and 52R is a swash-plate variable displacement axial pump driven by power from the engine 60. The travel pumps 52L and 52R each include pressure receivers 52*a* and 52*b* on which pilot pressure acts, and the swash plate angle is changed by the pilot pressure acting on the pressure receivers 52*a* and 52*b*. Changing the swash plate angle makes it possible to change the output of (amount of discharged hydraulic fluid from) the travel pumps 52L and 52R and the direction of discharge of hydraulic fluid. In other words, the travel pumps 52L and 52R, when the swash plate angle thereof is changed, thus change a driving force outputted to the traveling devices 4L and 4R.

The first travel motor mechanism 31L transmits power to a drive shaft of the traveling device 4L provided on the left side of the machine body 2. The second travel motor mechanism 31R is a mechanism which transmits power to a drive shaft of the traveling device 4R provided on the right side of the machine body 2. The first travel motor mechanism 31L includes travel motors 36L and 36R and a speed change mechanism.

Each of the travel motors 36L and 36R is, for example, a swash-plate variable displacement axial motor. The travel motor 36L is attached to the motor mounting portion 26 of the left frame portion 21 and transmits power for travel to the traveling device 4L. The travel motor 36R is attached to the motor mounting portion 26 of the right frame portion 20 and transmits power for travel to the traveling device 4R. Each of the travel motors 36L and 36R is configured to change vehicle speed (rotation) to first speed stage or second speed stage. In other words, the travel motors 36L and 36R are configured to change the driving force for the working machine 1, i.e., the driving force for the traveling devices 4L and 4R.

The speed change mechanism includes a swash plate switching cylinder 38*a* and a travel switching valve 38*b*. The swash plate switching cylinder 38*a* extends and retracts to change the swash plate angle of a corresponding one of the travel motors 36L and 36R. The travel switching valve 38*b* allows the swash plate switching cylinder 38*a* to extend/retract in either of two directions, and is a two-way switching valve which achieves switching between a first position 39*a* and a second position 39*b*. The travel switching valve 38*b* is caused to switch between the first and second positions 39*a* and 39*b* by a speed change switching valve 44. The speed change switching valve 44 is connected to the discharge fluid passage 40 and is also connected to the travel switching valve 38*b* of the first travel motor mechanism 31L and the travel switching valve 38*b* of the second travel motor mechanism 31R. The speed change switching valve 44 is a two-way switching valve which achieves switching between a first position 44*a* and a second position 44*b*. When the speed change switching valve 44 is in the first position 44*a*, the pressure of hydraulic fluid acting on the travel switching valves 38*b* of the speed change mechanisms is set to a pressure corresponding to a predetermined speed (for example, first speed stage). When the speed change switching valve 44 is in the first position 44*a*, the pressure of the hydraulic fluid acting on the travel switching valves 38*b* is set to a pressure corresponding to a speed (second speed stage) higher than the predetermined speed (first speed stage). Thus, when the speed change switching valve 44 is in the first position 44*a*, each travel switching valve 38*b* is brought into the first position 39*a*, causing each swash plate switching cylinder 38*a* to retract and changing the speed stage of the travel motors 36L and 36R to first speed stage. When the speed change switching valve 44 is in the second position 44*b*, each travel switching valve 38*b* is brought into the second position 39*b*, causing each swash plate switching cylinder 38*a* to extend and changing the speed stage of the travel motors 36L and 36R to second speed stage. Note that the speed stage of the travel motors 36L and 36R is changed to first speed stage or second speed stage under control by a work controller 70. For example, the work controller 70 is provided with an operation actuator 58 such as a switch (speed change switch) (see FIG. 8). Upon shifting of the operation actuator 58 into first speed stage, the work controller 70 outputs a control signal to deenergize a solenoid of the speed change switching valve 44 to bring the speed change switching valve 44 into the first position 44*a*. Upon shifting of the operation actuator 58 into second speed stage, the work controller 70 outputs a control signal to energize the solenoid of the speed change switching valve 44 to bring the speed change switching valve 44 into the second position 44*b*.

As illustrated in FIG. 5, the working machine 1 includes an operation device 53. The operation device 53 is a device for operation of the traveling devices 4L and 4R, i.e., for operation of the first travel motor mechanism 31L, the second travel motor mechanism 31R, and the travel drive mechanism 34. The operation device 53 includes a travel operation actuator 54 and a plurality of operation valves 55 (55*a*, 55*b*, 55*c*, and 55*d*). The plurality of operation valves 55 (55*a*, 55*b*, 55*c*, and 55*d*) are travel operation valves.

The travel operation actuator 54 is supported on the operation valves 55 and which swings sideways (along the machine body width direction) and along the front-rear direction. The plurality of operation valves 55 are operated by the same travel operation actuator 54, i.e., by a single travel operation actuator 54. The plurality of operation valves 55 function based on the swinging movement of the travel operation actuator 54. Hydraulic fluid (pilot fluid) can be supplied from the sub-pump P1 through the discharge fluid passage 40 to the plurality of operation valves 55. The plurality of operation valves 55 are the operation valve 55*a*, the operation valve 55*b*, the operation valve 55*c*, and the operation valve 55*d*.

The plurality of operation valves 55 and the travel drive mechanism 34 (travel pumps 52L and 52R) of the travel system are connected by a travel fluid passage 45. The travel fluid passage 45 includes a first travel fluid passage 45*a*, a second travel fluid passage 45*b*, a third travel fluid passage 45*c*, a fourth travel fluid passage 45*d*, and a fifth travel fluid passage 45*e*. The first travel fluid passage 45*a* is a fluid passage connected to the pressure receiver 52*a* of the travel pump 52L. The second travel fluid passage 45*b* is a fluid passage connected to the pressure receiver 52*b* of the travel pump 52L. The third travel fluid passage 45*c* is a fluid passage connected to the pressure receiver 52*a* of the travel pump 52R. The fourth travel fluid passage 45*d* is a fluid passage connected to the pressure receiver 52*b* of the travel pump 52R. The fifth travel fluid passage 45*e* is a fluid passage which connects the operation valves 55, the first travel fluid passage 45*a*, the second travel fluid passage 45*b*, the third travel fluid passage 45*c*, and the fourth travel fluid passage 45*d*. The fifth travel fluid passage 45*e* connects a plurality of shuttle valves 46 and the plurality of operation valves 55 (55*a*, 55*b*, 55*c*, and 55*d*).

Upon forward (in the direction indicated by arrow A1 in FIG. 5) swinging movement of the travel operation actuator 54, the operation valve 55*a* is operated, pilot pressure is determined by the operation valve 55*a*, the determined pilot pressure acts on the pressure receivers 52*a* of the travel pumps 52L and 52R, and the swash plate of each of the travel pumps 52L and 52R is tilted from a neutral position in a normal rotation direction, thus causing the travel pumps 52L and 52R to discharge hydraulic fluid. It follows that output shafts 35L and 35R of the travel motors 36L and 36R rotate in the normal direction (rotate to cause forward travel) at a speed that is proportional to the amount of the swinging movement of the travel operation actuator 54, and that the working machine 1 travels forward in a straight line.

Upon rearward (in the direction indicated by arrow A2 in FIG. 5) swinging movement of the travel operation actuator 54, the operation valve 55*b* is operated, pilot pressure is determined by the operation valve 55*b*, the determined pilot pressure acts on the pressure receivers 52*b* of the travel pumps 52L and 52R, and the swash plate of each of the travel pumps 52L and 52R is tilted from the neutral position in a reverse rotation direction, thus causing the travel pumps 52L and 52R to discharge hydraulic fluid. It follows that the output shafts 35L and 35R of the travel motors 36L and 36R rotate in the reverse direction (rotate to cause rearward travel) at a speed that is proportional to the amount of the swinging movement of the travel operation actuator 54, and that the working machine 1 travels rearward in a straight line.

Upon rightward (in the direction indicated by arrow A3 in FIG. 5) swinging movement of the travel operation actuator 54, the operation valve 55*c* is operated, pilot pressure is determined by the operation valve 55*c*, the determined pilot pressure acts on the pressure receiver 52*a* of the travel pump 52L and the pressure receiver 52*b* of the travel pump 52R, and the swash plate of the travel pump 52L is tilted in the normal rotation direction and the swash plate of the travel pump 52R is tilted in the reverse rotation direction. It follows that the output shaft 35L of the travel motor 36L on the left side rotates in the normal direction and the output shaft 35R of the travel motor 36R on the right side rotates in the reverse direction, so that the working machine 1 turns right (makes a spin turn). Upon leftward (in the direction indicated by arrow A4 in FIG. 5) swinging movement of the travel operation actuator 54, the operation valve 55*d* is operated, pilot pressure is determined by the operation valve 55*d*, the determined pilot pressure acts on the pressure receiver 52*b* of the travel pump 52L and the pressure receiver 52*a* of the travel pump 52R, and the swash plate of the travel pump 52L is tilted in the reverse rotation direction and the swash plate of the travel pump 52R is tilted in the normal rotation direction. It follows that the output shaft 35L of the travel motor 36L on the left side rotates in the reverse direction and the output shaft 35R of the travel motors 36R on the right side rotates in the normal direction, so that the working machine 1 turns left (makes a spin turn).

Upon diagonal swinging movement of the travel operation actuator 54, the difference between the pilot pressure acting on the pressure receivers 52*a* and the pilot pressure acting on the pressure receivers 52*b* determines the direction and speed of rotation of the output shafts 35L and 35R of the travel motor 36L on the left side and the travel motor 36R on the right side, and the working machine 1 turns right (makes a right pivot turn) or turns left (makes a left pivot turn) while traveling forward or rearward.

The working machine 1 may include an anti-stall control valve 48. The anti-stall control valve 48 is disposed in the fluid passage (discharge fluid passage 40) between the plurality of operation valves 55 (55*a*, 55*b*, 55*c*, and 55*d*) and the sub-pump P1. The anti-stall control valve 48 is a proportional solenoid valve, and the degree of opening of the anti-stall control valve 48 is variable. The anti-stall control valve 48 is configured to determine, according to a decrease ΔE1 in rotation speed of the engine 60 (engine speed), pilot pressure (primary pilot pressure) which acts on the plurality of operation valves 55 (55*a*, 55*b*, 55*c*, and 55*d*). The rotation speed of the engine can be detected by an engine speed sensor 91. The engine speed detected by the sensor 91 is inputted into the work controller 70.

Figure 7:
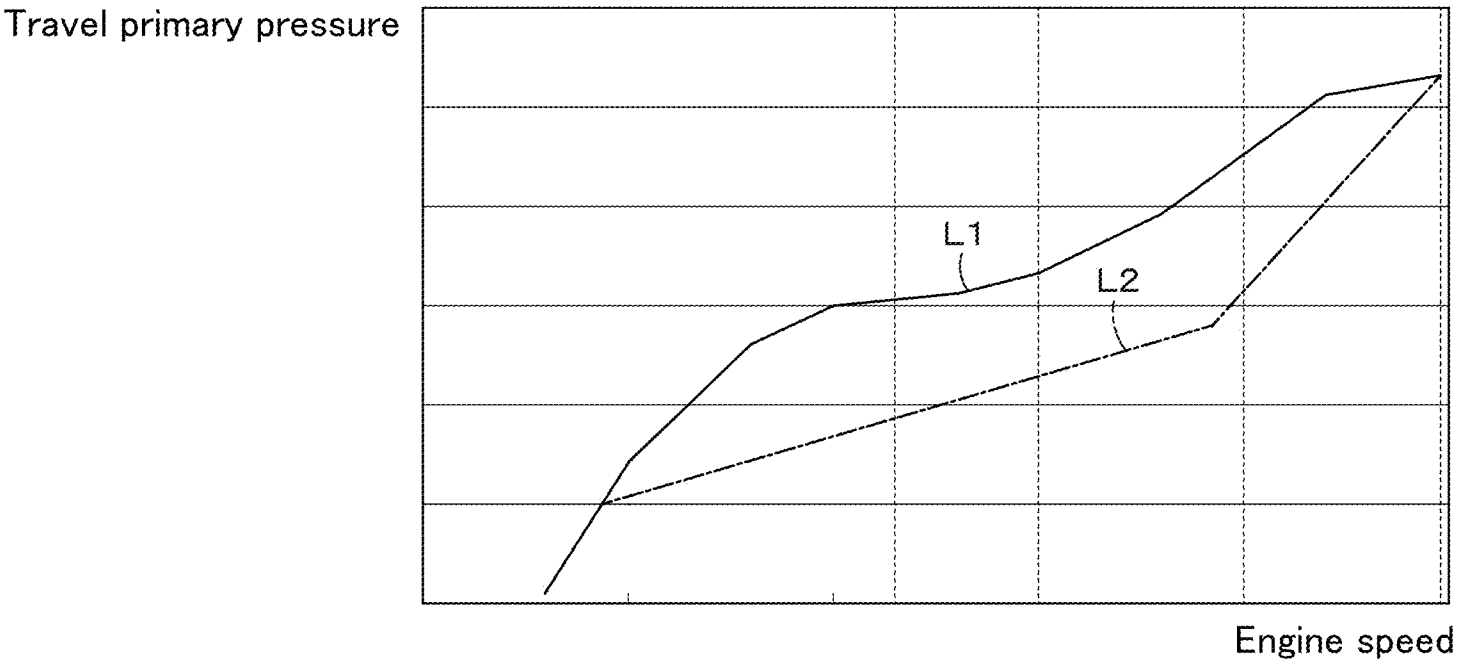
FIG. 7 shows a relationship between engine speed, travel primary pressure, and setting lines.

FIG. 7 shows a relationship between engine speed, travel primary pressure (primary pilot pressure), and setting lines L51 and L52. The setting line L51 represents a relationship between engine speed and travel primary pressure where the decrease ΔE1 is less than a predetermined value (less than anti-stall reference value). The setting line L52 represents a relationship between engine speed and travel primary pressure where the decrease ΔE1 is equal to or greater than the anti-stall reference value.

When the decrease ΔE1 is less than the anti-stall reference value, the work controller 70 adjusts the degree of opening of the anti-stall control valve 48 so that the relationship between the engine speed and the travel primary pressure matches a reference pilot pressure represented by the setting line L51. When the decrease ΔE1 is equal to or greater than the anti-stall reference value, the work controller 70 adjusts the degree of opening of the anti-stall control valve 48 so that the relationship between the engine speed and the travel primary pressure matches the setting line L52 which is below the reference pilot pressure. The travel primary pressure at a certain engine speed is lower on the setting line L52 than on the setting line L51. That is, when focus is put on a single engine speed, the travel primary pressure on the setting line L52 is set to be lower than the travel primary pressure on the setting line L51. Accordingly, with the control based on the setting line L52, the pressure of hydraulic fluid entering the operation valves 55 is kept low (pilot pressure is kept low). It follows that the swash plate angle of the travel pumps 52L and 52R is adjusted, the load on the engine is reduced, and the engine is prevented from stalling. Note that, although FIG. 7 shows a single setting line L52, a plurality of setting lines L52 may be present. For example, the setting lines L52 may be set for respective engine speeds. Data indicative of the setting line L51 and the setting line L52, control parameters such as functions, or the like are preferably stored in the work controller 70.

As illustrated in FIG. 6, the hydraulic system of the work system causes the working device 3 and/or the like to function. The hydraulic system of the work system is a system to cause the working device 3 to function using hydraulic pressure that occurs when the hydraulic driver 64 is driven. The hydraulic system of the work system includes a plurality of control valves 51 and a main pump P2 which is a hydraulic pump that discharges hydraulic fluid. The main pump P2 is located at a different position from the sub-pump P1, and includes a small displacement gear pump. The main pump P2 is configured to discharge hydraulic fluid from a hydraulic fluid tank. In particular, the main pump P2 mainly discharges hydraulic fluid to activate a hydraulic actuator.

There is a fluid passage 51*f* on the discharge side of the main pump P2. The fluid passage 51*f* has the plurality of control valves 51 connected thereto. The plurality of control valves 51 include a boom control valve 51*a*, a bucket control valve 51*b*, and an auxiliary control valve 51*c*. The boom control valve 51*a* is a valve to control the boom cylinders 14, the bucket control valve 51*b* is a valve to control the working tool cylinders 15, and the auxiliary control valve 51*c* is a valve to control a hydraulic actuator of the auxiliary attachment.

The booms 10 and the working tool 11 can be operated using a work operation actuator 37 of an operation device 43. The work operation actuator 37 is supported on a plurality of operation valves 59 and which swings sideways (along the machine body width direction) and along the front-rear direction. The operation valves 59 provided at the bottom of the work operation actuator 37 can be operated by tilting operation of the work operation actuator 37.

The plurality of operation valves 59 and the plurality of control valves 51 are connected to each other by a plurality of work fluid passages 47 (47*a*, 47*b*, 47*c*, and 47*d*). Specifically, the operation valve 59*a* is connected to the boom control valve 51*a* via the work fluid passage 47*a*. The operation valve 59*b* is connected to the boom control valve 51*a* via the work fluid passage 47*b*. The operation valve 59*c* is connected to the bucket control valve 51*b* via the work fluid passage 47*c*. The operation valve 59*d* is connected to the bucket control valve 51*b* via the work fluid passage 47*d*. The plurality of the operation valves 59*a* to 59*d* are each configured to determine, according to the operation of the work operation actuator 37, the pressure of hydraulic fluid to be outputted.

Upon forward tilting movement of the work operation actuator 37, the operation valve 59*a* is operated to output pilot pressure. The pilot pressure acts on a pressure receiver of the boom control valve 51*a* and hydraulic fluid having entered the boom control valve 51*a* is supplied to the rod side of each of the boom cylinders 14, thus lowering the booms 10.

Upon rearward tilting movement of the work operation actuator 37, the operation valve 59*b* is operated to output pilot pressure. The pilot pressure acts on another pressure receiver of the boom control valve 51*a* and hydraulic fluid having entered the boom control valve 51*a* is supplied to the bottom side of each of the boom cylinders 14, thus raising the booms 10.

That is, the boom control valve 51*a* is configured to control the flow rate of hydraulic fluid flowing to the boom cylinders 14 according to the pressure of hydraulic fluid determined by the operation of the work operation actuator 37 (pilot pressure determined by the operation valve 59*a*, pilot pressure determined by the operation valve 59*b*).

Upon rightward tilting movement of the work operation actuator 37, the operation valve 59*c* is operated and pilot pressure acts on a pressure receiver of the bucket control valve 51*b*. It follows that the bucket control valve 51*b* functions to cause the working tool cylinders 15 to extend, and the working tool 11 performs a dump action at a speed proportional to the amount of the tilting movement of the work operation actuator 37.

Upon leftward tilting movement of the work operation actuator 37, the operation valve 59*d* is operated and pilot fluid acts on another pressure receiver of the bucket control valve 51*b*. It follows that the bucket control valve 51*b* functions to cause the working tool cylinders 15 to retract, and the working tool 11 performs a scoop action at a speed proportional to the amount of the tilting movement of the work operation actuator 37.

That is, the bucket control valve 51*b* is configured to control the flow rate of hydraulic fluid flowing to the working tool cylinders 15 according to the pressure of hydraulic fluid determined by the operation of the work operation actuator 37 (pilot pressure determined by the operation valve 59*c*, pilot pressure determined by the operation valve 59*d*). That is, the operation valves 59*a*, 59*b*, 59*c*, and 59*d* change the pressure of hydraulic fluid according to the operation of the work operation actuator 37, and supply the hydraulic fluid having been subjected to pressure change to control valves such as the boom control valve 51*a*, the bucket control valve 51*b*, and/or the auxiliary control valve 51*c*.

Figure 8:
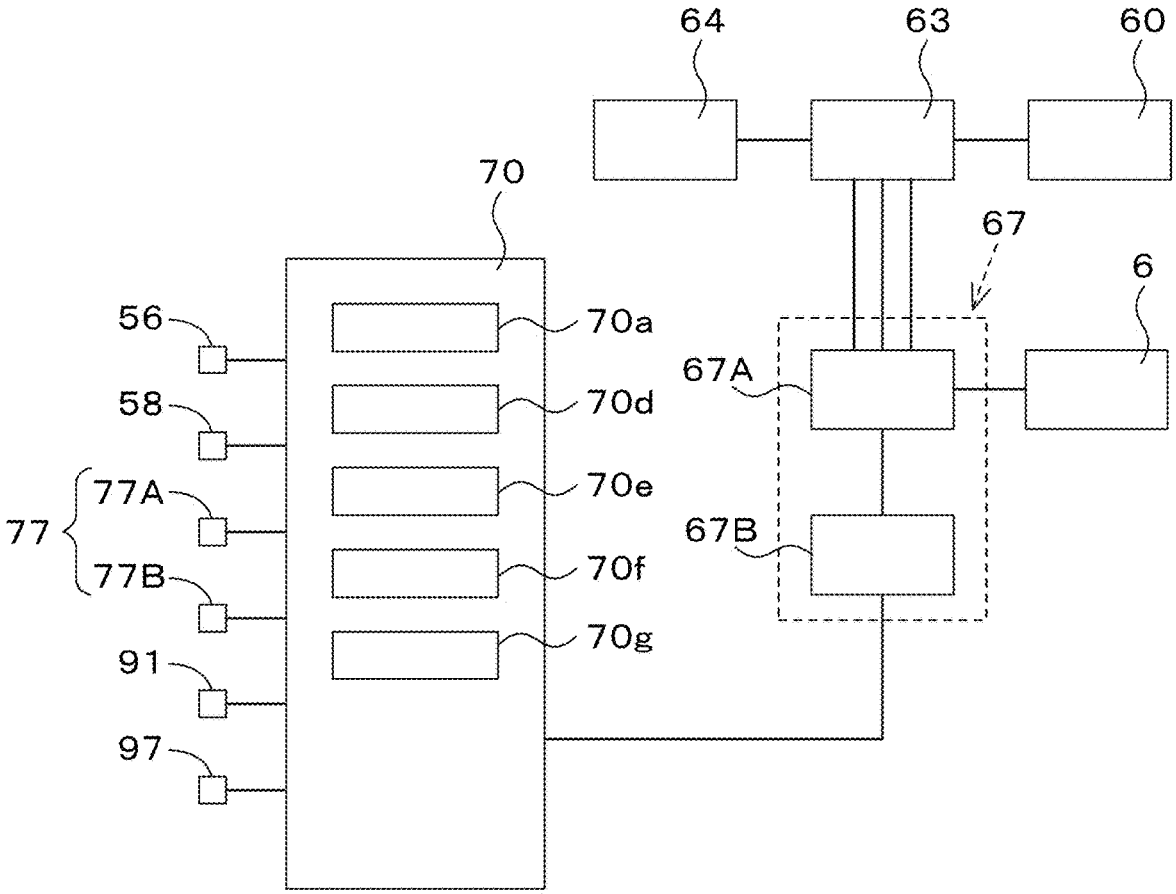
FIG. 8 is a control block diagram of the working machine.

The auxiliary attachment can be operated using a switch 56 provided in the vicinity of the operator's seat 7 (see FIG. 8). The switch 56 includes, for example, a swingable seesaw switch, a slidable slide switch, or a push switch that can be pressed. The operation of the switch 56 is inputted into the controller 70. A first solenoid valve 56*a* and a second solenoid valve 56*b*, each including a solenoid valve or the like, open according to the operation amount of the switch 56. It follows that pilot fluid is supplied to the auxiliary control valve 51*c* connected to the first solenoid valve 56*a* and the second solenoid valve 56*b*, and an auxiliary actuator of the auxiliary attachment is activated by hydraulic fluid supplied from the auxiliary control valve 51*c*.

Note that the operation amount of an operation actuator (work operation actuator 37, travel operation actuator 54) can be detected by an operation detecting device 77. The operation detecting device 77 is connected to the work controller 70 (described later). The operation detecting device 77 includes a first operation detecting device 77A and a second operation detecting device 77B. The first operation detecting device 77A detects the operation amount of the work operation actuator 37 (work operation amount). The second operation detecting device 77B detects the operation amount of the travel operation actuator 54 (travel operation amount). The first operation detecting device 77A and the second operation detecting device 77B are each, for example, a position sensor to detect the position of the operation actuator.

FIG. 8 is a control block diagram of the working machine 1. As illustrated in FIG. 8, the electricity controller 67 and the work controller 70 are connected to each other. The electricity controller 67 includes the inverter 67A and the inverter control unit 67B. The inverter 67A includes, for example, a plurality of switching elements, and, for example, convers direct current into alternating current by, for example, turning ON and OFF the switching elements. The inverter 67A is connected to the motor/generator 63 and the battery 66. The inverter control unit 67B includes a CPU, an electrical/electronic circuit, and/or the like. By outputting a predetermined signal to the inverter control unit 67B, the motor/generator 63 is caused to function as a motor or function as a generator. The amount of electricity stored in the battery 66 (remaining battery power) can be detected by the battery level sensor 97 of the battery 66.

The work controller 70 is a device to perform various types of control relating to the working machine, and includes a CPU, an electrical/electronic circuit, and/or the like. The work controller 70 performs control relating to hydraulic pressure (hydraulic fluid) (such control is hydraulic pressure control). In the hydraulic pressure control, the work controller 70 energizes and deenergizes the solenoids of the speed change switching valve 44, the first solenoid valve 56*a*, and the second solenoid valve 56*b*, as described earlier. The work controller 70 also is configured or programmed to act as a controller to control the electricity controller 67. The work controller 70 outputs an assist command to the inverter control unit 67B, and the inverter control unit 67B causes the motor/generator 63 to function as a motor. The work controller 70 outputs an electricity generation command to the inverter control unit 67B, and the inverter control unit 67B causes the motor/generator 63 to function as a generator. That is, the work controller 70 controls the motor/generator 63 to perform an assisting action in which the motor/generator 63 assists the engine in driving and an electricity generating action in which the motor/generator 63 functions as a generator to generate electricity using power from the engine 60. Note that the work controller 70 sends, to the electricity controller 67, settings and commands regarding motoring torque in the case of the assisting action of the motor/generator 63 and regenerative torque in the case of the electricity generating action of the motor/generator 63.

When the motor/generator 63 performs the assisting action, power from the engine 60 and the motor/generator 63 is transmitted to the hydraulic driver 64. When the motor/generator 63 performs the electricity generating action, power from the engine 60 is transmitted to the hydraulic driver 64, and electricity generated by the motor/generator 63 is stored in the battery 66. The motor/generator 63 is driven by the electricity stored in the battery 66.

Note that, although the work controller 70 and the electricity controller 67 are separate devices in the above-described preferred embodiment, the work controller 70 and the electricity controller 67 may be a single device. The above-described preferred embodiment does not impose or imply any limitation.

The work controller 70 includes a storage unit 70*a*, an action control unit 70*d*, a starting action determiner 70*e*, a first setter 70*f*, and a second setter 70*g*. The storage unit 70*a* includes a nonvolatile memory or the like. The action control unit 70*d*, the starting action determiner 70*e*, the first setter 70*f*, and the second setter 70*g* include electrical/electronic circuit(s) of the work controller 70, program(s) stored in the CPU and/or the like of the work controller 70, and/or the like. The storage unit 70*a*, the action control unit 70*d*, the starting action determiner 70*e*, the first setter 70*f*, and the second setter 70*g* may be provided in the electricity controller 67.

Figure 9:
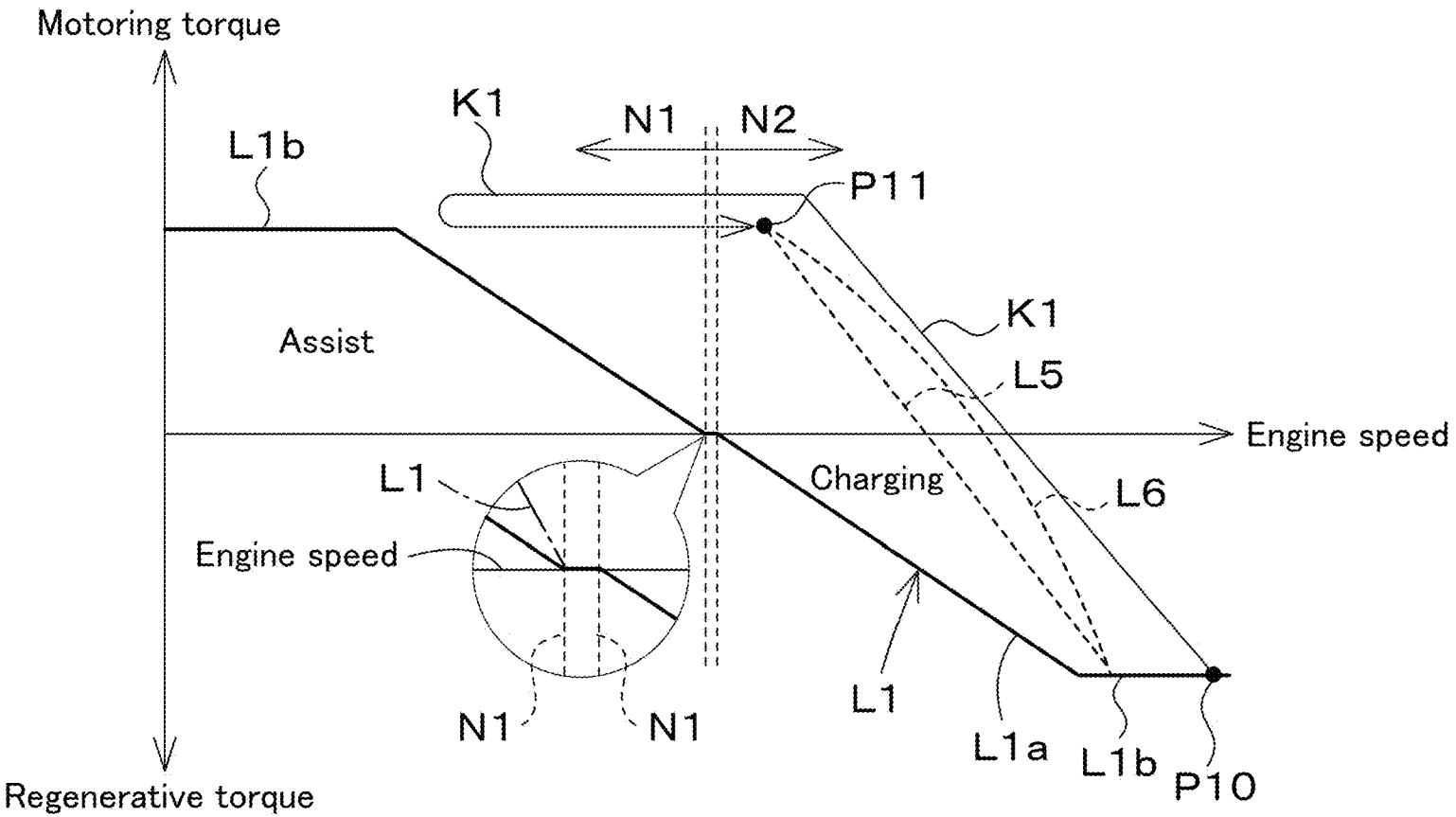
FIG. 9 shows an example of a control map.

The storage unit 70*a* stores therein control information for use when the motor/generator 63 performs the assisting action or charging action, e.g., a control map as shown in FIG. 9. The control map indicates a relationship between the rotation speed of the engine 60 (engine speed) and switching between the assisting action and the charging action (switching between actions), a relationship between engine speed and motoring torque in the case of the assisting action, and a relationship between engine speed and regenerative torque in the case of the charging action. Note that, although the control information is a control map in the above-described preferred embodiment, the relationship between engine speed and switching between actions, the relationship between engine speed and motoring torque in the case of the assisting action, and the relationship between engine speed and regenerative torque in the case of the charging action may be represented by a control table, parameters, functions, and/or the like, and the above-described preferred embodiment does not impose or imply any limitation. Note that the rotation speed of the engine can be detected by the engine speed sensor 91. The engine speed detected by the sensor 91 is inputted into the work controller 70.

As shown in FIG. 9, a standard line L1 is a line defined by second control information indicating the relationship between motoring torque for the assisting action and engine speed and the relationship between regenerative torque for the charging action and engine speed. The standard line L1 includes a sloping line Lia in which the torque changes with engine speed, and a constant line Lib in which the torque is constant regardless of engine speed.

The work controller 70 has, as control information, first control information which defines a correction line L5 (a line indicating the relationship between motoring torque and engine speed and the relationship between regenerative torque and engine speed) which differs from the standard line L1. The correction line L5 is not limited, and may be a line prepared by the work controller 70 at the time of control or may be pre-stored in the storage unit 70*a*, as described later.

The starting action determiner 70*e* determines, upon operation of an operation actuator such as the travel operation actuator 54, whether the operation corresponds to a starting action for the machine body 2. If the starting action determiner 70*e* determines that the operation corresponds to the starting action, the first setter 70*f* sets the motoring torque or regenerative torque for the assisting action or the electricity generating action to the torque represented by the correction line L5, when torque control is changed from the control at the time of the starting action (at a point in time P11) back to the control based on the standard line L1.

If the starting action determiner 70*e* determines that the operation does not correspond to the starting action, the second setter 70*g* sets the torque (the motoring torque or regenerative torque) for the assisting action or electricity generating action to the motoring torque corresponding to the engine speed using the standard line L1.

The action control unit 70*d* outputs, to the electricity controller 67, the torque set by the first setter 70*f* or the second setter 70*g*, and thus the assisting action or the electricity generating action is performed.

Figure 10:
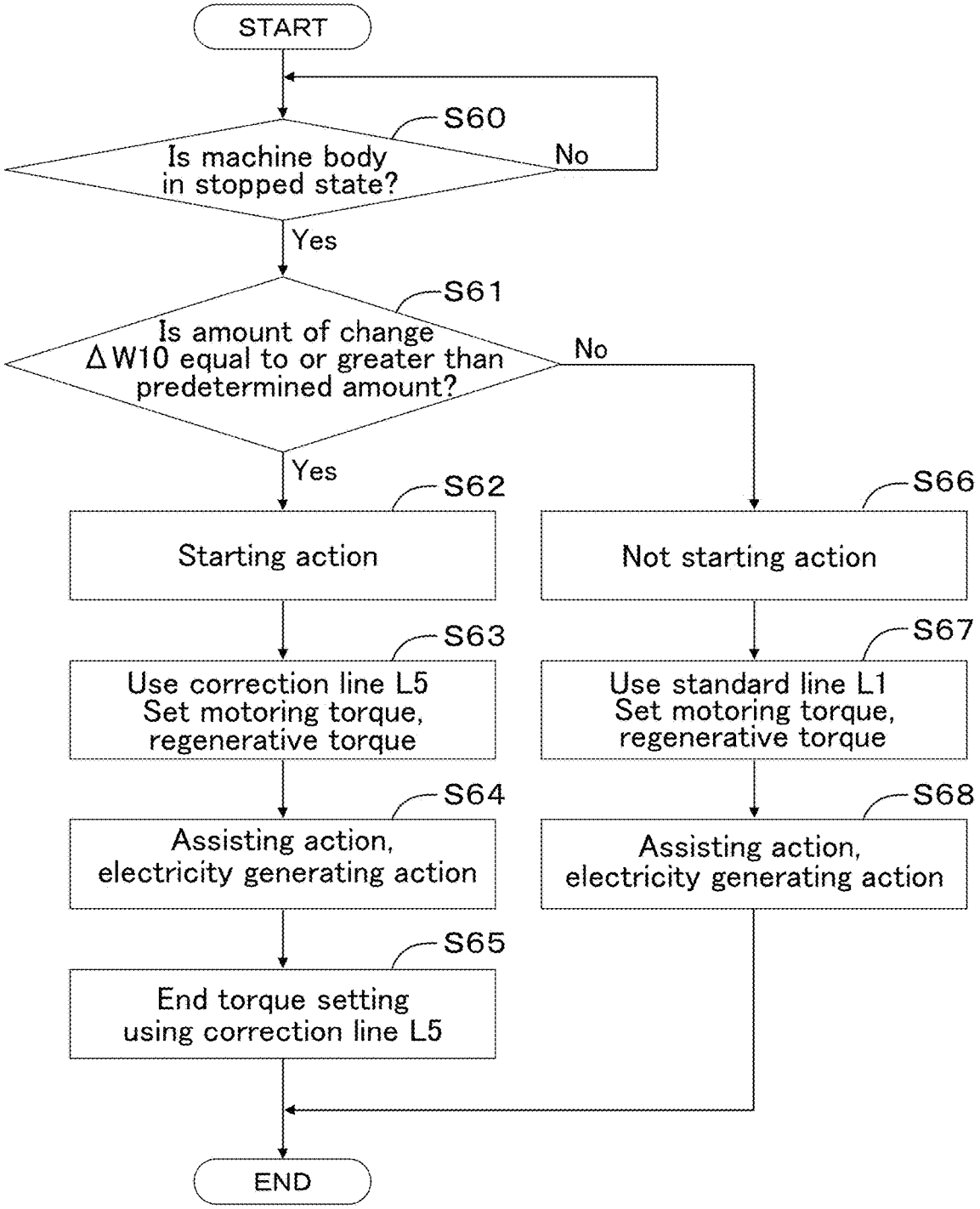
FIG. 10 is a flowchart regarding a starting action.

The following description specifically discusses actions performed in the case of the starting action and actions performed in the case of an action other than the starting action, with reference to FIGS. 9 and 10.

As shown in FIG. 10, the work controller 70 determines whether or not the machine body 2 is in its stopped state, i.e., the traveling devices 4L and 4R are in the stopped state (S60). If the travel operation actuator 54 is operated while the traveling devices 4L and 4R are in the stopped state (Yes in S60) (if travel operation amount is detected), the starting action determiner 70*e* determines whether or not the amount of change ΔW10 of the travel operation actuator 54 per unit time is equal to or greater than a predetermined amount (Yes in S61). If the amount of change ΔW10 is equal or greater than a predetermined amount (Yes in S61), the starting action determiner 70*e* determines that the operation corresponds to a starting action (S62). The first setter 70*f* performs a predetermined action corresponding to starting state. Then, if the engine speed increases, the first setter 70*f* sets motoring torque or regenerative torque based on the correction line L5 (S63). The action control unit 70*d* causes the assisting action or electricity generating action to be performed according to the motoring torque or regenerative torque set by the first setter 70*f* (S64). If the motoring torque or regenerative torque set by the first setter 70*f* is equal to that of the standard line L1, the setting by the first setter 70*f* ends (S65).

For example, as shown in FIG. 9, if the operation of the travel operation actuator 54 at the point in time P10 is abrupt (if the amount of change ΔW10 is equal to or greater than a predetermined amount), i.e., if the operation of the travel operation actuator 54 corresponds to the starting action, engine speed first decreases after the start of the operation of the travel operation actuator 54 and then starts increasing, as indicated by changes K1. At the point in time P11, if the starting action determiner 70*e* determines that the operation corresponds to the starting action, the first setter 70*f* provides assistance although the standard line L1 indicates charging. Then, motoring torque is set according to the correction line L5. The correction line L5 is a line in which motoring torque gradually decreases from the point in time at which the determination regarding the starting action was completed (point in time P11) whereas regenerative torque gradually increases from the point in time P11. The slope of the correction line L5 is steeper than the slope of the sloping line Lia of the standard line L1. That is, the amount of change (an increase or decrease) in torque per revolution (per engine revolution) in the correction line L5 is greater than the amount of change per revolution in the sloping line Lia. Note that the correction line L5 is a line not perpendicular to (not at a right angle to) the X axis representing engine speed.

The first setter 70*f* gradually reduces the motoring torque from the point in time P11 according to the correction line L5, and then increases the regenerative torque. The first setter 70*f* completes setting at the time at which the regenerative torque reaches the standard line L1.

On the other hand, if the amount of change ΔW10 is less than the predetermined amount (No in S61), the starting action determiner 70*e* determines that the operation does not correspond to the starting action (S66), and the second setter 70*g* sets motoring torque or regenerative torque based on the standard line L1 (S67). The action control unit 70*d* performs the assisting action or electricity generating action according to the motoring torque or regenerative torque set by the second setter 70*g* (S68).

Note that the starting action determiner 70*e* may determine that the operation corresponds to the starting action if the amount of change ΔW10 of the travel operation actuator 54 per unit time is equal to or greater than a predetermined amount and a decrease ΔE1 in engine speed is equal to or greater than a predetermined value. After the starting action determiner 70*e* determines that the operation corresponds to the starting action, the first setter 70*f* generates a correction line L6 which continues from the torque at which the operation was determined as corresponding to the starting action, and sets motoring torque based on the correction line L6. The correction line L6 is a line in the form of an arc. The first setter 70*f* sets motoring torque or regenerative torque along the arc of the correction line L6, and thus performs processing to bring the torque after the determination regarding the starting action back to the standard line L1. Note that the correction lines L5 and L6 may be stored in the work controller 70 as control information. That is, the correction lines L5 and L6 may be fixed lines prepared in advance. Alternatively, the correction lines L5 and L6 may be set according to the decrease ΔE1 in engine speed before the determination regarding the starting action, may be set according to the total decrease ΔE1 in engine speed, and may be set in some other manner.

The following may also be included or performed. The action control unit 70*d* may cause the charging action to be performed when, in the case where the starting action determiner 70*e* determines that the operation corresponds to the starting action, the point in time at which the determination regarding the starting action was performed is on the assisting action side and the remaining battery power (amount of stored electricity) of the battery 66 is smaller than a predetermined remaining battery power.

As shown in FIG. 9, if the operation of the travel operation actuator 54 at the point in time P10 is not abrupt (if the amount of change ΔW10 is less than a predetermine amount), the second setter 70*g* sets regenerative torque according to the engine speed at the point in time P10 on the standard line L1, and the action control unit 70*d* causes the electricity generating action to be performed.

A working machine 1 according to a preferred embodiment of the present invention includes a machine body 2, an engine 60, a motor/generator 63, a battery 66, an operation actuator, a starting action determiner 70*e* to determine, upon operation of the operation actuator, whether the operation corresponds to a starting action for the machine body 2, a first setter 70*f* to set, if the starting action determiner 70*e* determines that the operation of the operation actuator corresponds to the starting action, a torque of the motor/generator 63 for the assisting action or the electricity generating action to a first torque, and a second setter 70*g* to set, if the starting action determiner 70*e* determines that the operation of the operation actuator does not correspond to the starting action, the torque for the assisting action or the electricity generating action to a second torque differing from the first torque set by the first setter 70*f*. This makes it possible to efficiently perform the assisting action or the electricity generating action when a starting action for the working machine 1 is performed. That is, even in the case where the engine speed decreases when a starting action for the working machine 1 is performed, it is possible to stably perform the assisting action or the electricity generating action.

The starting action determiner 70*e* determines that the operation of the operation actuator corresponds to the starting action if an amount of change of the operation actuator is equal to or greater than a predetermined amount, and determines that the operation of the operation actuator does not correspond to the starting action if the amount of change of the operation actuator is less than the predetermined amount. This makes it possible to easily detect whether or not the operation of the operation actuator corresponds to the starting action, based on the operation of the operation actuator.

The machine body 2 includes traveling devices 4L and 4R configured to function using power from the engine and the motor/generator 63, and the operation actuator is a travel operation actuator 54 for operation of the traveling devices. This makes it possible to properly perform the assisting action when the working machine 1 in its stopped state is started to travel.

The first setter 70*f* sets the torque based on first control information indicating a relationship between a rotation speed of the engine and the first torque, and the second setter 70*g* sets the torque based on second control information indicating a relationship between the rotation speed of the engine and the second torque, the other relationship differing from the relationship used by the first setter 70*f*. This makes it possible to properly set the torque to that corresponding to the engine speed differently in the case where the operation of the operation actuator corresponds to the starting action and in the case where the operation of the operation actuator does not correspond to the starting action.

The starting action determiner 70*e* determines whether or not the operation of the operation actuator corresponds to the starting action based on a decrease ΔE1 in the rotation speed of the engine in a case where the operation actuator is operated. This makes it possible to easily determine whether the operation of the operation actuator corresponds to the starting action based on the load on the engine 60 at the time of the starting action, i.e., based on the decrease ΔE1.

The above-described preferred embodiments preferably use a configuration in which, when the work operation actuator 37 and the travel operation actuator 57 are operated, the operation valves 55 and 59 are caused to change pilot pressure. However, electrically driven operation actuators may be used. That is, the operation devices 43 and 53 may be devices to cause the hydraulic driver 64 and the control valves 51 and 48 to function using an electrical signal.

While preferred embodiments of the present invention have been described above, it is to be understood that the preferred embodiments disclosed herein are considered as examples in all aspects and are not considered as limitations. The scope of preferred embodiments of the present invention is to be determined not by the foregoing description but by the claims, and is intended to include all variations and modifications within the scope of the claims and their equivalents.

What is claimed is:

1. A working machine comprising:

a machine body;

an engine on the machine body;

a motor/generator to perform an assisting action in which the motor/generator functions as a motor to assist the engine in driving and an electricity generating action in which the motor/generator functions as a generator to generate electricity using power from the engine;

a battery to store electricity generated by the motor/generator;

an operation actuator for operation of the machine body;

a starting action determiner to determine, upon operation of the operation actuator, whether the operation corresponds to a starting action for the machine body;

a first setter to set, if the starting action determiner determines that the operation of the operation actuator corresponds to the starting action, a torque of the motor/generator for the assisting action or the electricity generating action to a first torque based on first control information indicating a relationship between (i) motoring torque for the assisting action and regenerative torque for the electricity generating action, and (ii) a rotation speed of the engine; and a second setter to set, if the starting action determiner determines that the operation of the operation actuator does not correspond to the starting action, the torque for the assisting action or the electricity generating action to a second torque differing from the first torque set by the first setter based on second control information indicating another relationship between (i) the motoring torque and the regenerative torque, and (ii) the rotation speed of the engine, the another relationship differing from the relationship indicated by the first control information.

2. The working machine according to claim 1, wherein the starting action determiner determines that the operation of the operation actuator corresponds to the starting action if an amount of change of the operation actuator is equal to or greater than a predetermined amount, and determines that the operation of the operation actuator does not correspond to the starting action if the amount of change of the operation actuator is less than the predetermined amount.

3. The working machine according to claim 1, wherein the machine body includes a traveling device to function using power from the engine and the motor/generator; and the operation actuator is a travel operation actuator for operation of the traveling device.

4. The working machine according to claim 1, wherein the starting action determiner determines whether or not the operation of the operation actuator corresponds to the starting action based on a decrease in the rotation speed of the engine in a case where the operation actuator is operated.

5. The working machine according to claim 2, wherein the starting action determiner determines that the operation of the operation actuator corresponds to the starting action if the amount of change of the operation actuator is equal to or greater than the predetermined amount and a decrease in the rotation speed of the engine is equal to or greater than a predetermined value.

* * * * *